US006330968B1

(12) United States Patent
Peleman

(10) Patent No.: US 6,330,968 B1
(45) Date of Patent: Dec. 18, 2001

(54) FILE FOLDER WITH CONNECTING SIDE PIECES

(75) Inventor: Guido Peleman, Puurs (BE)

(73) Assignee: Unibind (Cyprus) Limited, Cyprus ( * ) Notice: Subject to any disclaimer, the term of this patent is extended or adjusted under 35 U.S.C. 154(b) by 0 days.

(21) Appl. No.: 09/366,045

(22) Filed: Aug. 2, 1999

Related U.S. Application Data

(63) Continuation-in-part of application No. 08/943,300, filed on Oct. 14, 1997, now Pat. No. 5,931,373.

(30) Foreign Application Priority Data

Oct. 15, 1996 (BE) ..... 09600870

(51) Int. Cl.[7] ..... B65D 37/00

(52) U.S. Cl. ..... 229/122.24; 229/67.4; 220/690; 206/425

(58) Field of Search ..... 229/122.24, 122.21, 229/122.22, 122.23, 194, 67.1, 67.2, 67.3, 67.4; 206/308.1, 308.3, 425; 220/690, 691

(56) References Cited

U.S. PATENT DOCUMENTS

| | | | | |
|---|---|---|---|---|
| 324,588 | | 8/1885 | Powers . | |
| 761,181 | | 5/1904 | Rich . | |
| 1,202,042 | * | 10/1916 | Fairchild et al. | 229/122.25 X |
| 1,743,305 | | 1/1930 | Banks . | |
| 1,929,144 | | 10/1933 | Kearney . | |
| 2,041,974 | | 5/1936 | Sloan . | |
| 2,493,281 | * | 1/1950 | Anderson, Jr. | 229/122.26 |
| 2,906,267 | | 9/1959 | Loudon . | |
| 3,675,807 | | 7/1972 | Lund et al. . | |
| 3,915,372 | | 10/1975 | Crane . | |
| 4,211,358 | | 7/1980 | Crane . | |
| 4,482,074 | | 11/1984 | Lalley . | |
| 5,038,998 | | 8/1991 | Morris et al. . | |
| 5,497,939 | | 3/1996 | Heiskell et al. . | |
| 5,664,724 | | 9/1997 | Ho . | |
| 5,931,373 | * | 8/1999 | Peleman | 229/67.4 X |

FOREIGN PATENT DOCUMENTS

| | | |
|---|---|---|
| 25 14 353 | 10/1976 | (DE) . |
| G91 12 737.8 | 2/1992 | (DE) . |
| G91 14 778.6 | 4/1992 | (DE) . |
| 758012 | 9/1956 | (GB) . |
| 1134859 | 11/1968 | (GB) . |
| 2 236 738 | 4/1991 | (GB) . |
| DM/017 594 | 9/1990 | (WO) . |

* cited by examiner

*Primary Examiner*—Stephen P. Garbe
*Assistant Examiner*—Tri Mai
(74) *Attorney, Agent, or Firm*—Bacon & Thomas PLLC

(57) ABSTRACT

A file folder includes a front sheet and a rear sheet made of a rigid material which are connected to each other by a flexible back. At least one of the sheets has an inwardly directed flap. Connecting pieces connected to side edges of the flap keep the flap spaced from the respective sheet to which the flap is attached, with the connecting pieces attached to the respective sheet and the flap by mechanical connections, for example mortise and tenon joints. Locking elements prevent the mortise and tenon joints from losening.

7 Claims, 5 Drawing Sheets

FILE FOLDER WITH CONNECTING SIDE PIECES

CROSS REFERENCE TO RELATED APPLICATION

This application is a continuation-in-part of U.S. patent application Ser. No. 08/943,300 filed Oct. 14,1997, issued as U.S. Pat. No. 5,931,373 on Aug. 3, 1999.

BACKGROUND OF THE INVENTION

1. Field of the Invention

The present invention relates to a file folder, more particularly to a file folder which may be used to contain bundles of loose documents or periodicals and the like.

More particularly, it concerns a file folder which has an inwardly directed flap and connecting side pieces which keep the flap spaced at a distance from the sheet to which the flap is attached.

2. Description of the Related Art

With the known types of file folders, the connecting side pieces are glued to the edges of the flap and to the edges of the respective sheet to which the flap is attached.

These known embodiments have a number of drawbacks. For instance, the assembly must be done in the factory and the file folder occupies more space in its finished shape. This is disadvantageous for storage in the factory, as well as with the user, and for transport. Moreover, each desired thickness requires another file folder, which requires a stock composed of file folders of different thicknesses.

The quality of the connection between the connecting side pieces and the edges is difficult to control for the known embodiments because the connections are made using glue (adhesive). Quality control is only possible in a destructive way, whereby the file folder cannot be used anymore.

SUMMARY OF THE INVENTION

The present invention aims therefore at excluding the above-mentioned and other disadvantages of the known file folders. To this end, the file folder according to the invention comprises a front sheet and a rear sheet made of a rigid material which are connected to each other by a flexible back. At least one of the sheets has an inwardly directed flap. At its side edges, the flap is kept spaced by connecting side pieces at a distance from the sheet to which the flap is attached. The connecting side pieces are at least attached to the sheet and to the flap by mechanical connections.

In the most preferred embodiment, the mechanical connections comprise mortise and tenon joints. However, other connections, such as snap connections, are not excluded.

It is clear that the file folder according to the invention has the advantage that it may be assembled at the moment of its use. As a result, the volume of the file folders which must be maintained in inventory or storage is reduced considerably.

With one file folder which must be assembled, connecting side pieces of different thicknesses (widths) may be used. Therefore, only one type of file folder needs to be kept in inventory instead of two or three types, as was previously the case. The user himself may now determine which type of file folder he assembles. In other words, he himself may choose the desired folder thickness.

In a preferred embodiment, the mortise and tenon joints will not only be provided between the connecting side pieces and the sheet and the flap, but likewise between the connecting side pieces and the flexible link between the flap and the sheet.

BRIEF DESCRIPTION OF THE DRAWINGS

In order to better show the characteristics of the invention, a preferred embodiment according to the present invention is described hereafter, as an example and without any restrictive character whatsoever, reference being made to the accompanying drawings, in which.

DETAILED DESCRIPTION OF THE PREFERRED EMBODIMENT

Figure 1:
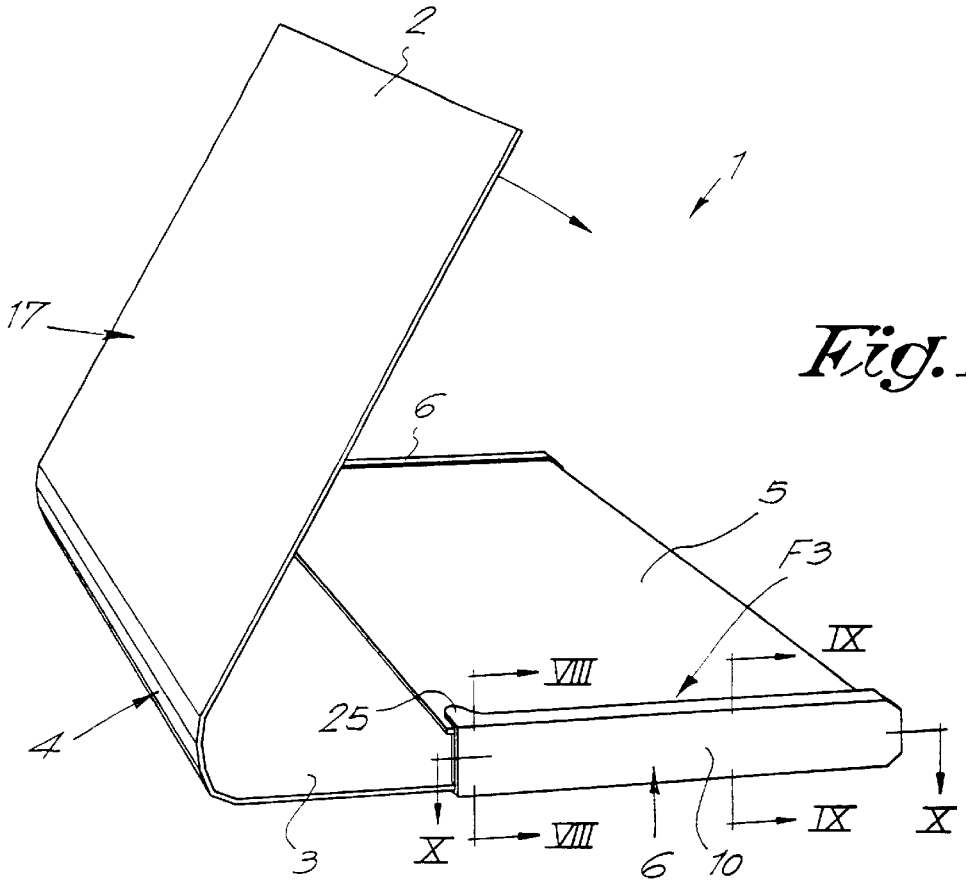
FIG. 1 represents a perspective view of a file folder according to the invention.

The file folder 1 according to the invention comprises, as represented in FIG. 1, a front sheet 2 and a rear sheet 3 made of a rigid material which are connected to each other by a flexible back section 4. In this case, rear sheet 3 is elongated by a flap 5 which is folded back. Flap 5 is kept spaced at a distance from sheet 3 by two connecting side pieces 6.

Figure 2:
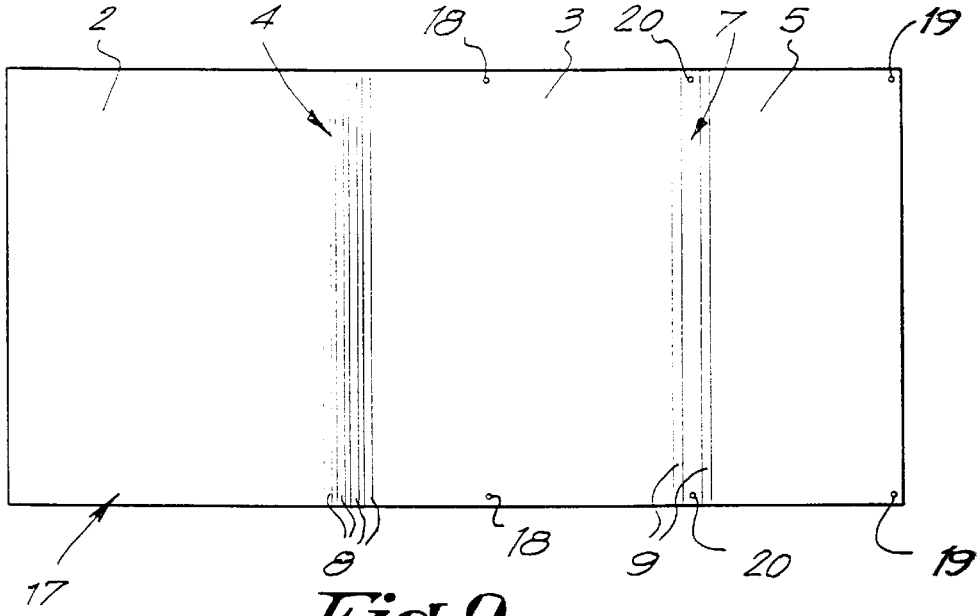
FIG. 2 represents a top view of an unfolded file folder shown in FIG. 1.

Front sheet 2, rear sheet 3, back section 4 and flap 5 are preferably manufactured from a type of thick cardboard and may be provided with a covering, such as a smooth foil which is bonded to the cardboard. As represented in FIG. 2, a number of fold lines 8–9 may be provided at the spot of back section 4 and a fold panel 7 between rear sheet 3 and flap 5, for example may be made by thinning of the material, such as indentations.

As represented in FIGS. 3 to 7, each connecting side piece 6 comprises a single piece made of synthetic material mainly formed of an elongated wall 10 having inwardly directed edges 11–12–13 located at three sides thereof. The inwardly directed edges form supports for the edges of rear sheet 3, fold panel 7 and flap 5.

Figure 9:
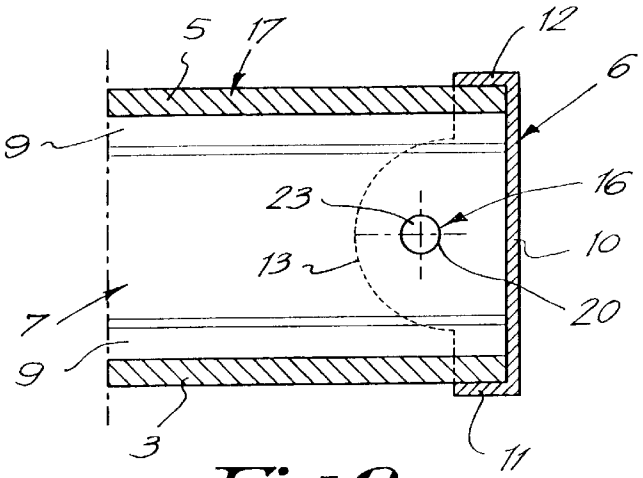
FIGS. 8 and 9 represent cross-sectional views on an enlarged scale, according to lines VIII—VIII and IX—IX, respectively, in FIG. 1, whereby these cross-sections are taken at the same spots as the ones of FIGS. 4 and 5 in FIG. 3.
Figure 8:
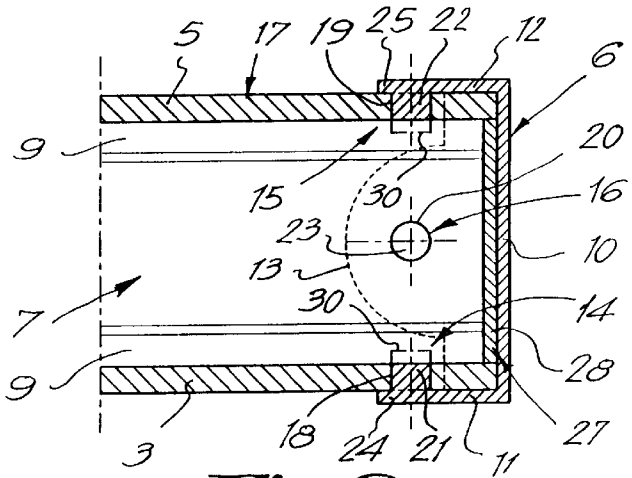
Figure 10:
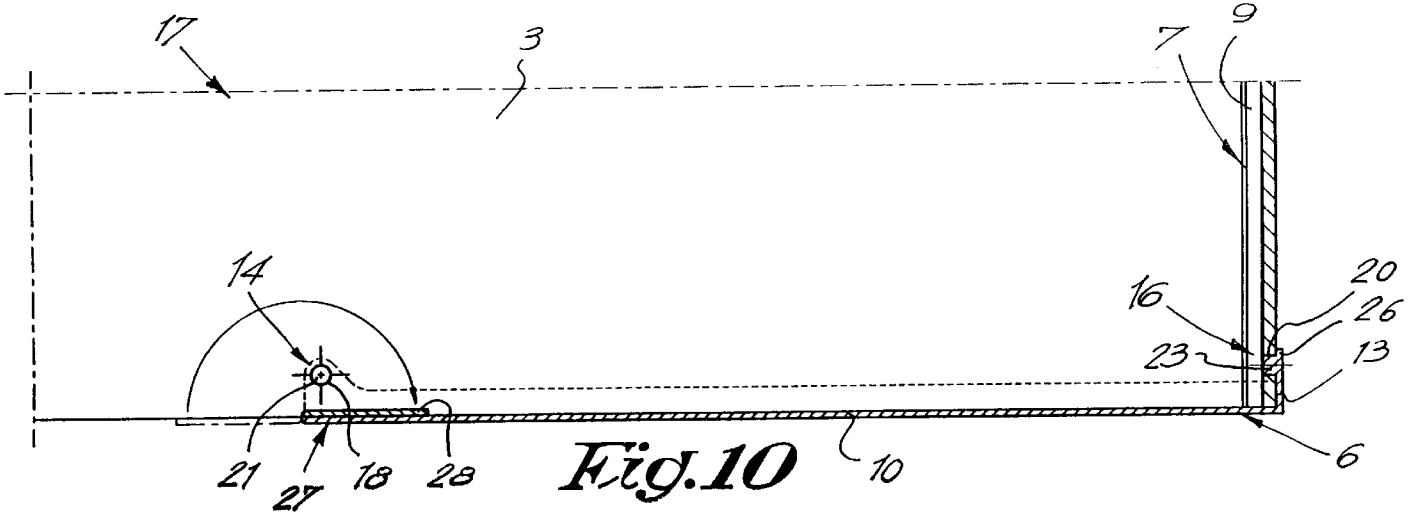
FIG. 10 represents a cross-sectional view according to line X—X in FIG. 1.

As represented in FIGS. 8 to 10, connecting side pieces 6 are attached to the file folder by mechanical connections, more particularly a plurality of mortise and tenon joints. In this case, three connections for each connecting piece 6, namely 14–15–16, are used.

As represented in the example, the mortise and tenon joints are not only provided between connecting side pieces 6 and rear sheet 3 and flap 5, but likewise between connecting side pieces 6 and panel 7. More particularly, three mortise and tenon joints are provided for each connecting side piece 6, two mortise and tenon joints 14–15 at free extremities of inwardly directed edges 11 and 12 and a third mortise and tenon joint 16 at inwardly directed edge 13, respectively.

To realize mortise and tenon joints 14–15–16, a plurality of mortises 18–19–20 are applied on the file folder 17, as represented in FIG. 2. Corresponding tenons 21–22–23 are applied on connecting side pieces 6 such that they are integrally formed with connecting side pieces 6. Tenons 21–22–23 are located at an inner side of inwardly directed edges 11–12–13, preferably at protruding lips 24–25–26 so as to extend perpendicular inwardly into engagement with the adjacent mortises 18–19–20 in panels 3,5 and 7.

Tenons 21–22–23 are preferably of a circular shape and are of a length which corresponds with the thickness of the material from which the file folder 17 is made. The diameter of tenons 21–22–23 preferably corresponds with the diameter of mortises 18–19–20 or is even a little greater such that during the assembly a friction locking effect is obtained.

Figures 3, 4, 5, 6, 7:
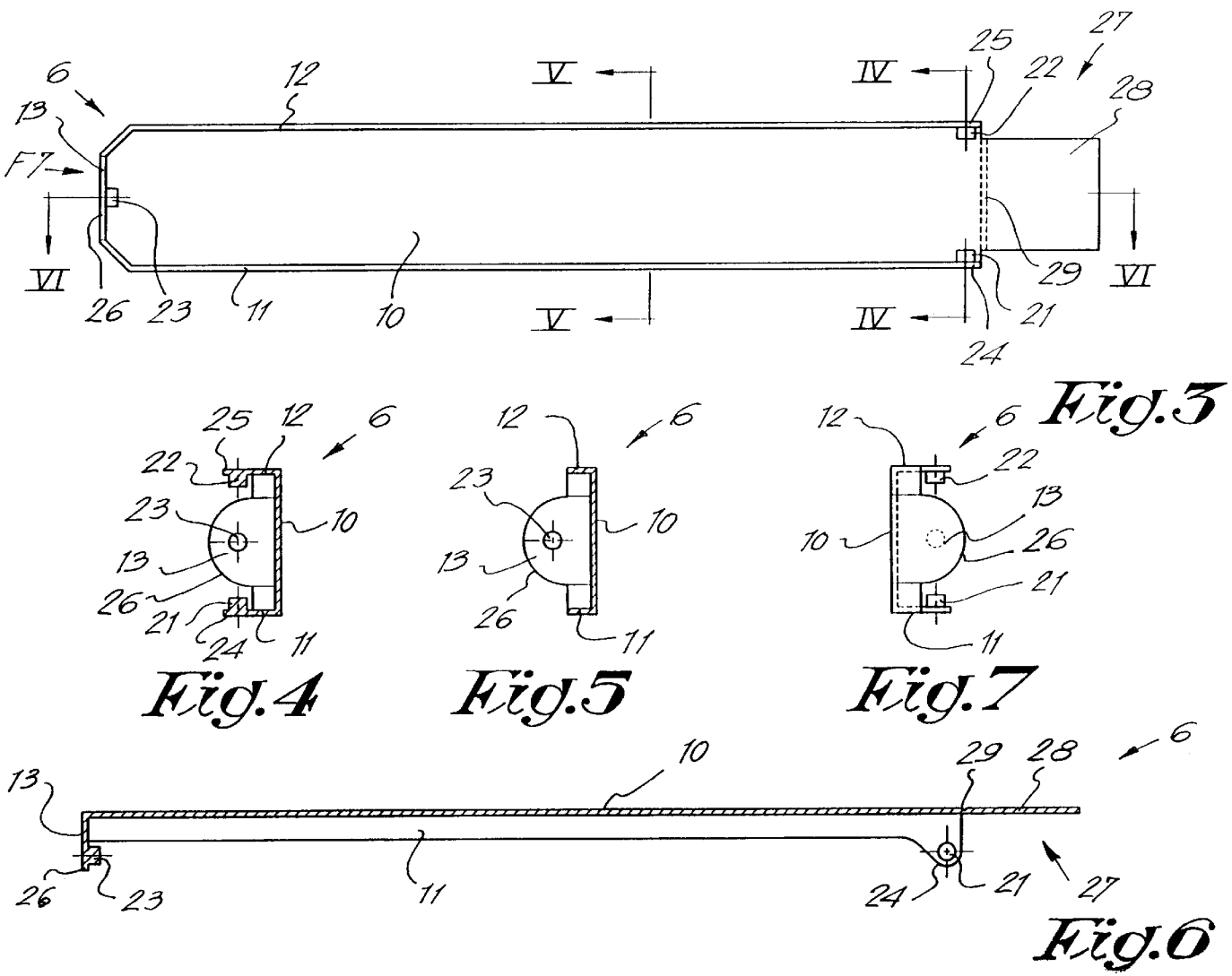
FIG. 3 represents a view of the inner side of the connecting piece which is indicated in FIG. 1 by F3.
FIGS. 4, 5 and 6 represent cross-sectional views, according to lines IV—IV, V—V and VI—VI, respectively, in FIG. 3.
FIG. 7 represents a view according to the arrow F7 in FIG. 3.

As is made clear in FIGS. 3, 8 and 10, file folder 1 may be provided with a lock 27 which prevents mortise and tenon joints 14–15–16 from becoming loose due to motion of panels 3 and 5 towards each other. To this end, lock 27 includes folding parts 28 which are attached to connecting pieces 6 and may be folded inwardly between the respective sheet, in this case rear sheet 3, and flap 5 such that rear sheet 3 and flap 5 cannot move towards each other anymore. Consequently, they cannot become loose from tenons 21–22. Because mortise and tenon joints 14–15 cannot be loosened anymore, the result is obtained that connecting side pieces 6 cannot slide away laterally with respect to file folder 17. As a result, mortise and tenon joints 16 cannot become loose anymore.

Foldable panels 28 are integrally formed with the connecting side pieces 6 and are foldable at one edge by a weakening in material 29.

As represented by dashed lines 30 in FIG. 8, tenons 21 and 22 may possibly be made longer than the thickness of the material of file folder 17. As a result, folding part 28 may be clamped more or less behind tenons 21–22 and consequently may spring back only a little or not at all.

It is clear that according to a variant, flap 5 may also be located adjacent front sheet 2. It is also not excluded to attach a flap 5 to front sheet 2 as well as to rear sheet 3 by connecting pieces 6.

The assembly of file folder 1 may be deduced simply from the figures. In the first instance, flap 5 must be brought completely inwardly until abutting rear sheet 3. Subsequently, connecting side pieces 6 are applied such that mortise and tenon joint 16 is formed. Then, by pushing flap 5 and rear sheet 3 away from each other, mortise and tenon joints 14–15 are formed or connected. The file folder may be locked then by foldable parts 28.

Tenons 21–22–23 may have several shapes. According to the invention, they may also comprise local protuberances of the material. Mortises 18–19–20 must not be continuous mortises.

An alternate embodiment of the invention is illustrated in FIGS. 11–14, wherein mechanical connections are used in cooperation with locking elements that are separate from the connecting side pieces to maintain the separation between the rear sheet and flap and loosening of the mortise and tenon joints.

More specifically, a file folder 101 includes rear or first sheet 103, front or second sheet 102 and flap 105 connected to the rear sheet 103 by a back section 104. Flap 105 is maintained in spaced relationship with respect to rear sheet 103 by connecting side pieces 106. The front and rear sheets, and the flap as well as the back section are all made of relatively rigid material suitable for use in a file folder, for example the material described with respect to the file folder 1 shown in FIG. 1. Appropriate fold lines 108 connect the rear sheet 103 to flap 105 and fold lines 109 connect the front sheet 102 to the rear sheet 103.

The front sheet 102 and the rear sheet 103 are made of a rigid material, each having a first edge 102A, 103A, a second edge 102B, 103B and two side edges 102C, 103C. The back section 104 includes a first edge along the first edge 105A of the flap 105, and a second edge along the second edge 103B of the first sheet 103. The flap 105 is also made of a rigid material and flexibly connected to the flap 105 and first sheet 103.

Connecting side pieces 106 comprise a single piece made of synthetic material and comprise an elongated side wall 110 having inwardly directed edges 111,112,113 located at three sides thereof. The inwardly directed edges form supports for the lateral edges of rear sheet 103, back section 104 and flap 105, as described previously in connection with the embodiment shown in FIG. 1.

Figure 12:
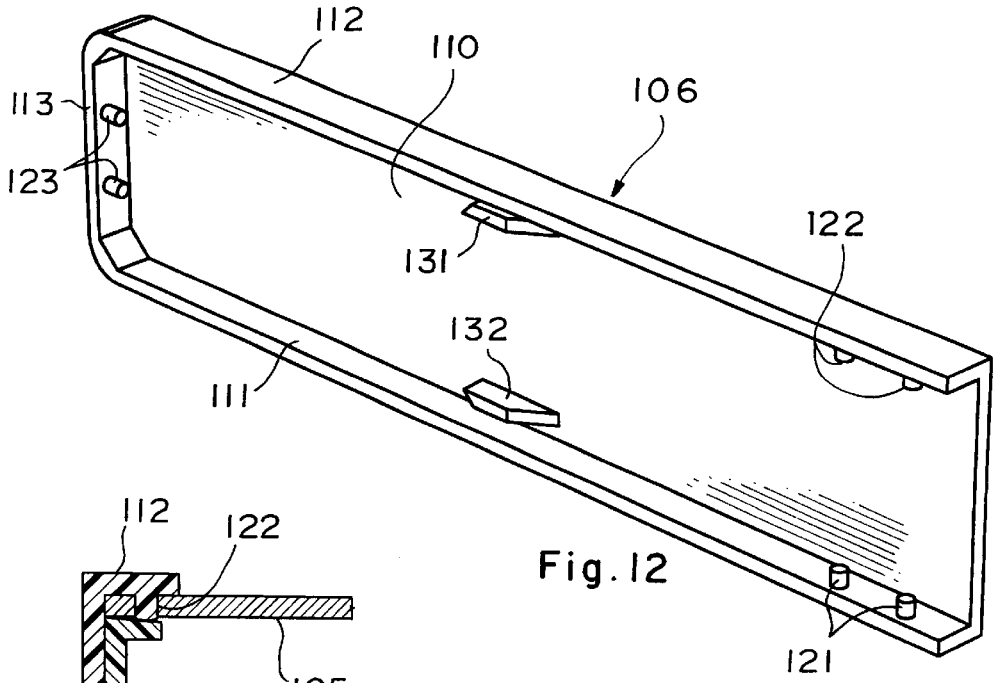
FIG. 12 is a perspective view of a connecting side piece shown in FIG. 11.
Figure 13:
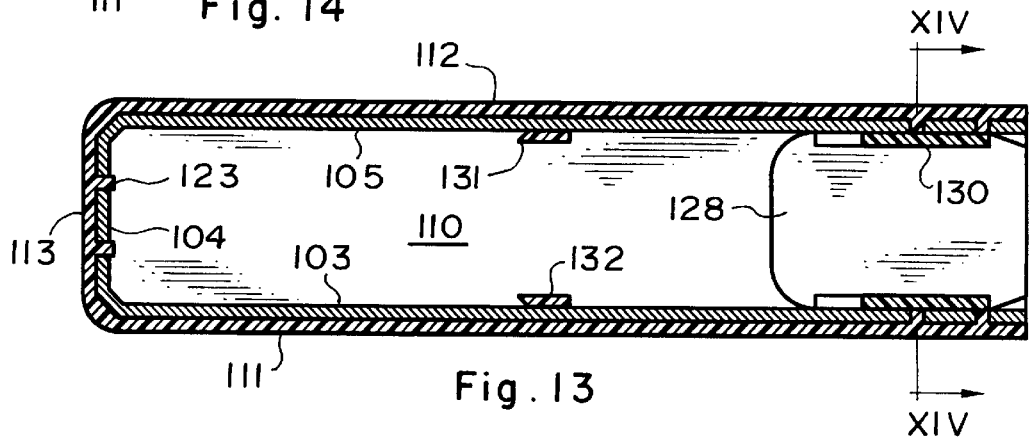
FIG. 13 is a vertical sectional view taken through an assembled file folder according to FIG. 11 taken through a connecting side piece.

Connecting side pieces 106 are attached to the file folder by mechanical connections, more particularly a plurality of mortise and tenon joints. As seen in FIG. 12, the connecting side pieces 106 includes tenon elements 121,122,123 projecting vertically from each inwardly directed edge 111,112 and 113. In addition, a pair of inwardly projecting sheet edge support elements 131,132 adjacent and spaced slightly away from inwardly directed edges 111,112 is provided about midway along the length of each side piece 106 to support edges of sheets 103,105 as shown in FIG. 13. Sheets 103 and 105 are provided with mortises 118,119 and back section 104 is provided with mortises 120. The mortise and tenon joints comprise circular pins 121,122,123 and mating apertures 118,119 and 120. Other shapes and forms of mortises and tenons could be utilized in accordance with the general knowledge of those skilled in the art.

Figure 11:
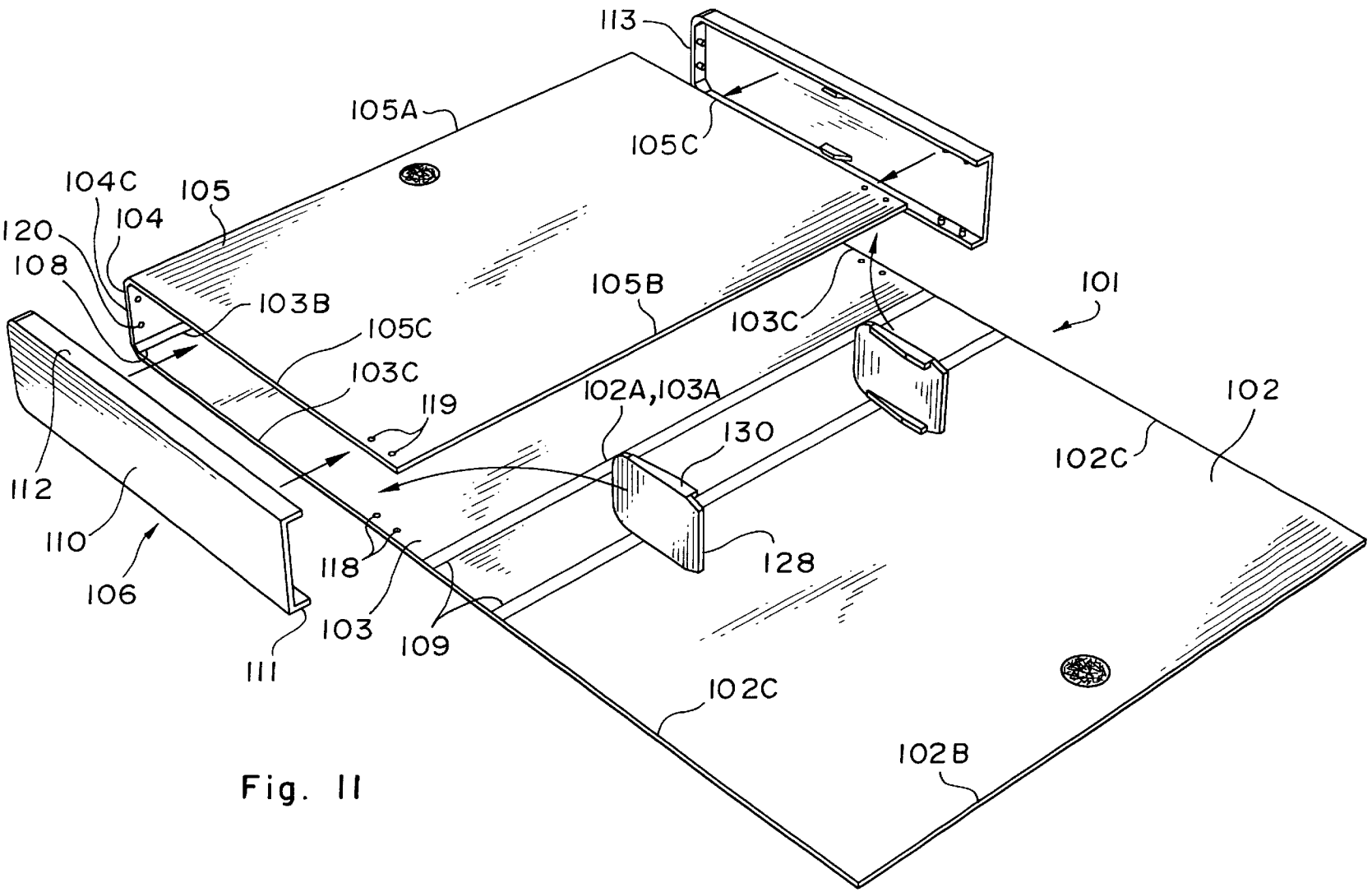
FIG. 11 is a perspective view of a file folder according to an alternate embodiment of the invention.

FIG. 13 is a vertical sectional view taken through the folder shown in FIG. 11 after it has been assembled, with the view taken through a connecting side piece 106 to show the relationship between the rear sheet 103, the back section 104, the flap 105 as well as the mortise and tenon joints retaining the connecting side pieces 106 assembled with the sheets 103,105 and back section 104.

Figure 14:
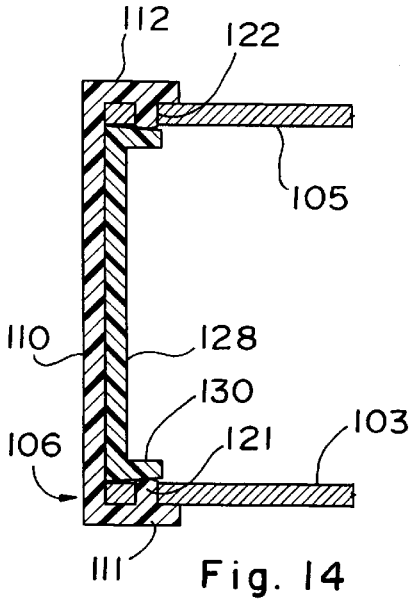
FIG. 14 is a vertical sectional view taken along line XIV—XIV in FIG. 13.

A pair of locking elements 128 separate from the flap 105, sheet 103 and connecting side pieces 106 are inserted between rear sheet 103 and flap 105 as illustrated in FIGS. 13 and 14. Each locking element 128 includes a panel element and inwardly extending edges 130 that, in the assembled position, overlies tenon elements 121,122 to prevent inward displacement of sheet 103 and flap 105 relative to connecting side pieces 106, and clamps the flap and sheet to the edges 111, 112.

Each locking element 128 may be made of a material similar to that of the side pieces or any other appropriate relatively rigid synthetic resin material suitable to perform the desired locking function for preventing inward movement of sheet 103 and flap 105. The inwardly extending edges 130 may be connected to the panel portion of a respective locking element 128 by a flexible elastic connection so that they may be bent inwardly slightly as illustrated in FIG. 14 when they engaged the opposite tenon elements 121,122 of the connecting side pieces 106, and exert a resilient bias (friction or snap connection) between the opposed tenons 121,122.

When fully assembled, it will be fully evident that the sheet and flap 103,105 are retained in separated relationship along their side edges and the side pieces 106 may not be separated from the rear sheet 103, back section 104 and flap 105.

The present invention is in no way limited to the embodiments described above and represented in the drawings, but such a file folder may be realized in different shapes and dimensions, without departure from the scope of the invention.

What is claimed is:

1. A file folder, comprising:

a first sheet forming a first sidewall made of a rigid material having a first edge, a second edge and two side edges;

a second sheet made of a rigid material having a first edge, a second edge and two side edges;

a flap forming a second sidewall made of a rigid material having a first edge, a second edge and two side edges;

a back section having a first edge, a second edge and two side edges, the back section flexibly connected to said first sheet at respective ones of said first edges and said flap at respective ones of said second edges;

said first and second sheets flexibly connected at their respective ones of said first edges, said second sheet inwardly directable towards the flap;

a pair of connecting side pieces which connect said flap to said first sheet at said side edges such that said flap is kept spaced at a distance from said first sheet, said connecting side pieces being attached to said flap and said first sheet by mechanical connections positioned on the second sidewall of said flap and on the first sidewall of said first sheet; and locking elements inserted between the flap and said first sheet at said side edges, said locking elements cooperating with the mechanical connections to prevent them from becoming loose, and the locking elements comprise discrete elements separate from said at least one of said sheets, flap and connecting side pieces.

2. The file folder as claimed in claim 1, wherein the locking elements comprise panels spanning the distance between a pair of mechanical connections at said side edges.

3. The file folder as claimed in claim 2, wherein said panels fit between said locking elements in a clamping relationship with said flap and said at least one of said sheets, whereby the flap and a respective one of the sheets are clamped between said panels and a connecting side piece.

4. The file folder as claimed in claim 1, wherein the mechanical connections comprise mortise and tenon joints.

5. The file folder as claimed in claim 4, wherein said connecting side pieces each include an elongated side wall and inwardly directed edges on opposite sides of the side wall; tenon elements extending generally vertically from each inwardly directed edge and towards an opposed inwardly directed edge; said flap and said at least one of said sheets including mortises configured to cooperate with said tenon elements; said locking elements comprising discrete panel elements separate from said at least one sheet, flap and connecting side pieces, said panel elements spanning the distance between opposed tenon elements of said connecting side pieces and including portions that clamp a flap edge and an edge of said at least one sheet between said panel and an inwardly directed edge of a connecting side piece in a manner that prevents each tenon element from loosening from a respective mortise with which it is engaged.

6. The file folder as claimed in claim 5, wherein said locking elements include inwardly directed flange elements at opposed edges of said panel elements, said flange elements connected to a respective panel element in a manner enabling elastic flexing between each flange element and the respective panel element; said flange elements fitting in an interference friction fit relationship between opposed tenon elements and constituting said portions of said panel elements that clamp a flap edge and an edge of said at least one sheet between the panel elements and an inwardly directed edge of a connecting side piece in a manner that prevents each mortise element from loosening from a respective tenon with which it is engaged, said flange elements flexing towards each other and relative to a respective panel element when fitted between mortise elements.

7. The file folder as claimed in claim 5, wherein said connecting side pieces each includes a pair of inwardly extending edge supports located closely adjacent and spaced from an inwardly directed edge of the respective side piece to thereby define a sheet edge receiving opening between each edge support and an adjacent inwardly directed edge, each edge support located approximately midway along said elongated side wall.

* * * * *